United States Patent [19]

Cibie et al.

[11] Patent Number: 4,530,042

[45] Date of Patent: Jul. 16, 1985

[54] DIPPED HEADLAMP FOR AUTOMOBILES

[75] Inventors: Pierre Cibie, Bobigny; Hector Fratty, Boulogne; Norbert Brun, Bobigny, all of France

[73] Assignee: Cibie Projecteurs, Bobigny, France

[21] Appl. No.: 551,049

[22] Filed: Nov. 14, 1983

[30] Foreign Application Priority Data

Nov. 19, 1982 [FR] France ..... 82 19382

[51] Int. Cl.[3] ..... F21M 3/16

[52] U.S. Cl. ..... 362/309; 362/297; 362/348; 362/61

[58] Field of Search ..... 362/61, 80, 307–311, 362/347, 348, 346, 350, 297; 313/113

[56] References Cited

U.S. PATENT DOCUMENTS

| | | | |
|---|---|---|---|
| 1,610,124 | 12/1926 | Godley | 362/348 |
| 3,317,772 | 5/1967 | Lindae | 313/113 |
| 3,818,210 | 6/1974 | Pitkjaan | 362/61 |
| 3,858,040 | 12/1974 | Ricard | 362/309 |
| 4,238,817 | 12/1980 | Fratty | 362/61 |
| 4,272,801 | 6/1981 | Fratty | 362/61 |
| 4,303,965 | 12/1981 | Uile et al. | 362/61 |
| 4,351,018 | 9/1982 | Fratty | 362/348 |

FOREIGN PATENT DOCUMENTS

| | | | |
|---|---|---|---|
| 2322369 | 11/1974 | Fed. Rep. of Germany | 313/113 |
| 2644365 | 4/1978 | Fed. Rep. of Germany . | |
| 2856448 | 7/1980 | Fed. Rep. of Germany | 362/309 |
| 1337858 | 8/1963 | France . | |
| 1393430 | 2/1964 | France | 362/309 |
| 1546698 | 10/1967 | France . | |
| 2463356 | 8/1979 | France | 362/309 |
| 113184 | 10/1978 | Japan | 362/309 |
| 532090 | 1/1941 | United Kingdom | 362/308 |
| 1042394 | 7/1963 | United Kingdom | 362/308 |
| 2069121 | 8/1981 | United Kingdom | 362/309 |

*Primary Examiner*—Parshotam S. Lall
*Assistant Examiner*—W. R. Wolfe
*Attorney, Agent, or Firm*—McCormick, Paulding & Huber

[57] ABSTRACT

A headlamp comprising a reflector of which at least one sector is in the form of a paraboloid of reduction, a bulb with an axial filament offset upwards in the radial direction with respect to the axis of the paraboloid, and a light-distributing glass placed in front of the reflector. The filament is centered in the axial direction on the focus of the paraboloid. The surfaces of the reflector situated outside the sector in the form of a paraboloid are designed so as to produce images of the filament which are all situated below the cut-off. Alternatively, the light-distributing glass participates in the deflection, in combination with the surfaces of the reflector. In an advantageous variant the reflector is completely parabolic and homologous deflecting zones are then provided on the light-distributing glass to lower all the images thus produced below the cut-off.

16 Claims, 12 Drawing Figures

FIG_1
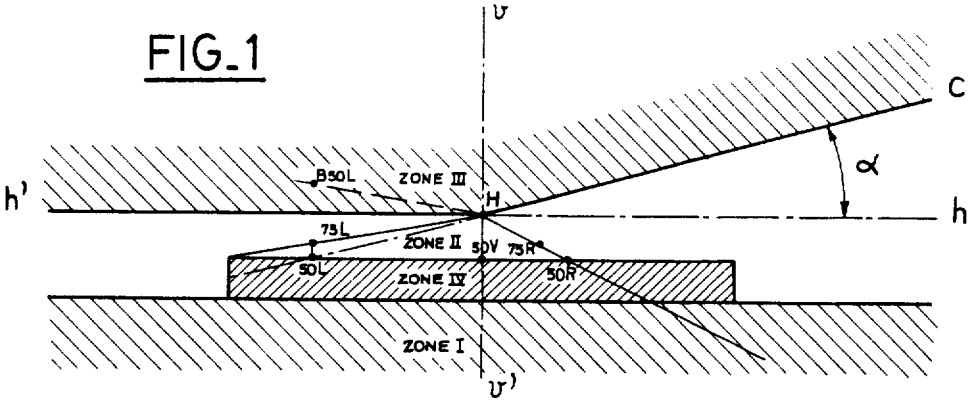
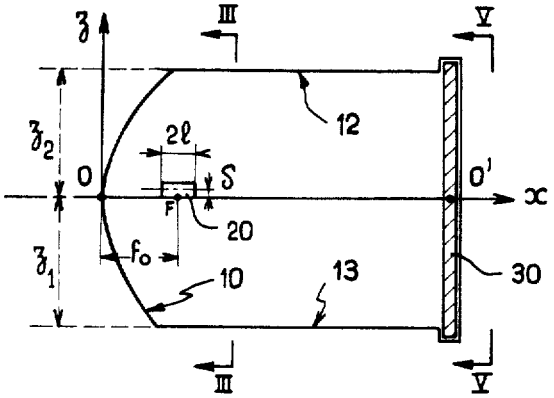
FIG_2
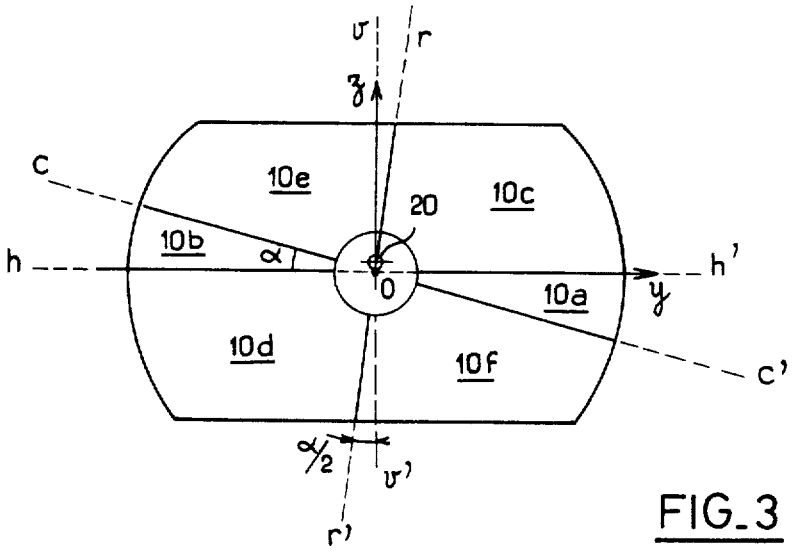
FIG_3

DIPPED HEADLAMP FOR AUTOMOBILES

BACKGROUND OF THE INVENTION

The present invention relates to a headlamp for automobiles which is intended to form a dipped beam.

This beam is characterised by a "cut-off", that is to say a directional limit above which no light rays are emitted. This cut-off generally consists of a horizontal half-plane to the left of the horizontal axis of the headlamp (for driving on the right-hand side of the road) and a half-plane which is slightly inclined upwards to the right of the said axis. This latter half-plane is raised by an "angle of upward inclination of the cut-off" which for a standard European beam is 15°.

The illumination produced by such a beam on a screen placed 25 meters in front of the headlamp is shown in FIG. 1, with its standard points and zones, the point H being the trace of the focal axis of the headlamp at the intersection of the vertical plane v'v and the horizontal plane h'h. The cut-off is defined by the trace Hh' of the left-hand horizontal plane lowered by 1% and by the trace Hc forming an angle $\alpha$ with respect to the trace Hh (here, as below, the description refers to driving on the right-hand side of the road. For driving on the left-hand side of the road it is sufficient to consider the Figures showing the screen or the headlamp reversed with respect to the axis v'v).

The zone III located above the cut-off is a zone of minimal illumination in order to avoid dazzle. The zone IV, on the other hand, is the zone of maximum illumination for which a strong intensity of the beam must be sought. Conventionally the cut-off is obtained by means of a screening cap which surrounds the lower part of the bulb or its filament and thus only allows the passage of the rays directed towards the top of the reflector associated with the bulb which after reflection will form the lower part of the beam. In order to obtain the required focusing, the filament of the bulb is arranged in the axis of the parabolic reflector, slightly in front of the focus thereof.

The disadvantage of this arrangement is the significant loss of luminous flux emitted by the filament because of the screening caused by the cap. Thus almost half the flux is emitted as pure loss. It will be understood that this loss is particularly critical for headlamps of small dimensions for which the reduced size of the reflector only permits recovery of sufficient luminous flux at the expense of increasing the power of the light source.

In order to avoid the use of a cap, a headlamp having the following structure has been proposed:

a reflector of which at least one sector is in the form of a paraboloid of revolution extending symmetrically on either side of the axis between two axial planes, one horizontal and the other forming with the latter an angle equal to the angle of upward inclination of the cut-off of the dipped beam, bulb with an axial filament, this filament being on the one hand offset upwards in the radial direction with respect to the axis of the paraboloid and on the other hand centered in the axial direction on the focus of the paraboloid, and a light-distributing glass placed in front of the reflector in which the zones which are homologous to those of the sector in the form of a paraboloid are smooth or slightly deviatory.

Such an arrangement of the elements of the headlamp is described notably in French Patent Specification No. A-1546698 in the name of the present applicants. It makes it possible to produce the cut-off because of its property of forming images all situated below the latter. However, the sector in the form of a paraboloid is very narrow (the angle of aperture $\alpha$ is generally 15°), and in order to maintain acceptable efficiency it is necessary to recover the luminous flux corresponding to the rays not reflected by the sector in the form of a paraboloid.

For this the aforementioned document proposes placing two recuperator mirrors on either side of the sector in the form of a paraboloid, formed by two offset semi-paraboloids; the upper one focused on the rear end of the filament forms a conventional dipped beam and the lower one focused on the front end of the filament forms all its images below the cut-off.

Such a headlamp has two disadvantages: first of all the reflector has a discontinuous surface located at the junction of each recuperator mirror with the central sector: the paraboloids of the two adjacent surfaces, focused on different points, of necessity have either a different apex or different focal lengths and consequently have different profiles along the connecting plane. Therefore in this plane it is impossible to find a common connecting line and the transition of a recuperator mirror to the central sector of necessity represents a break. Because of this characteristic a reflector produced in accordance with this teaching is in practice imperfect in this transition zone, which manifests itself by an emission of light rays above the cut-off.

In the second place, and above all, the beam produced by the lower recuperator is spread over almost all of the zone situated below the cut-off: this widening of the beam goes against the desired aim in a dipped beam which is to obtain concentration in a central zone just below the cut-off (notably the standard zone IV).

It is for this reason that the said soluton has not been adopted in order to produce a dipped beam and that, in practice, the cut-off has always up to now been obtained by means of a screening cap.

SUMMARY OF THE INVENTION

One of the objects of the invention is to propose a dipped headlamp without a cap but which makes it possible to obtain a greater light intensity in a certain number of preferred zones of the beam where it is desirable to arranged a stronger illumination, thus avoiding the disadvantages of the reflector with offset paraboloids as described above.

Because of the omission of the cap both the upper part of the reflector and its lower part can participate in the recovery of the luminous flux: the overall intensity of the dipped beam is thus greater than with a conventional headlamp with a cap. For this purpose according to the invention the headlamp also has deflector means to displace below the beam cut-off all the images of the filament coming from the zone of the reflector extending beyond the axial planes, these deflector means comprising deflecting surfaces which prolong the sector in the form of a paraboloid on either side of the axial planes without discontinuity.

In a first embodiment the deflector means are formed by the deflecting surfaces themselves, these being capable by themselves of forming images of the filament in which all the points are situated below the beam cut-off, the zones of the light-distributing glass which are homologous to the deflecting surfaces being smooth or slightly deviatory in the vertical direction.

The deflecting surfaces are preferably capable of forming images of the filament having all their highest points aligned on the beam cut-off.

In a second embodiment the deflecting surfaces cooperate with homologous deflecting zones of the light-distributing glass in such a way as to form images of the filament in which all the points are situated below the beam cut-off. Thus it is the combination of the deflecting surfaces and the light-distributing glass which forms the deflector means, the useful deflecting effect being shared by these two elements.

In a preferred form of this second embodiment the deflecting surfaces are formed by the paraboloid of the central sector, extending beyond the axial planes. The useful deflecting effect is then essentially achieved by the light-distributing glass.

BRIEF DESCRIPTION OF THE DRAWINGS

FIG. 1 shows schematically the illumination of a dipped beam headlamp on a screen at 25 meters;

FIG. 2 is a vertical axial section of a headlamp according to the invention;

FIG. 3 is a front view of the reflector in the direction III—III in FIG. 2;

DESCRIPTION OF THE PREFERRED EMBODIMENTS

The headlamp according to the invention, shown schematically in FIG. 2, comprises a reflector 10, an axial filament 20 and a light-distributing glass 30 which closes the headlamp. By contrast with the conventional headlamp with a screening cap, in which the filament is arranged in front of the focus of the parabolic reflector (the axis of the filament being merged with the axis of the reflector, or sometimes offset upwards with reference to the latter), in the headlamp according to the invention the filament is offset upwards by a value equal to the radius of the filament, in the radial direction, with reference to the axis Ox of the reflector and is centered in the axial direction on the focus F of the zone in the form of a paraboloid of the said reflector.

The axial offsetting $\delta$ is such that the emitting surface of the filament is substantially tangential to the axis Ox with a maximum tolerance in one direction or the other of 25% of the diameter of the filament, that is to say a tolerance of $\pm 0.3$ mm for a filament of the current type with a diameter of 1.2 mm. The axial centering of the filament at the focus of the paraboloid is achieved with a maximum tolerance in one direction or the other of 10% of the length of the filament, that is to say a tolerance of approximately $\pm 0.5$ mm for a filament of the conventional type with a length of 5.5 mm.

Figure 4A:
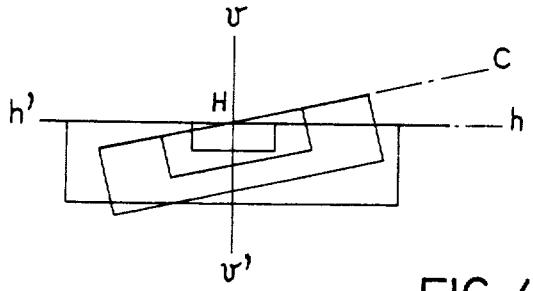
FIGS. 4*a* to 4*c* show the images coming from different zones of the reflector of FIG. 3 when formed on a standard screen.

The reflector has (FIG. 3) at least one sector in the form of a paraboloid extending symmetrically on either side of the axis Ox between two axial planes, one horizontal hh', the other cc' forming with the first an angle $\alpha$ equal to the angle of upward inclination of the cut-off of the dipped beam. This parabolic sector is represented by the zones 10*a* and 10*b* in FIG. 3. The images of the filament reflected by these two zones onto a standard screen are shown in FIG. 4*a*. It will be seen that these images start at the cut-off h'Hc and are all situated below producing a concentration of light at the standard point 75R (see FIG. 1). This is one of the points where the minimum illumination required by the various regulations is highest.

It will be noted that, although the reflector has not been modified in relation to a conventionl reflector, due to the zones 10*a* and 10*b* there is nevertheless double the luminous flux in the vicinity of the zone of concentration (standard points 75R and 50R) compared to an arrangement using a screening cap which only makes use of the zone 10*b*.

Furthermore, whilst in the conventional arrangement one end of the filament is placed at the focus F or in front of the latter, in the configuration described here it is the middle of the filament which is lcoated at the focus. Since the middle of the filament has a temperature, and consequently a luminance, very much higher than the end of the filament, the emerging beam has a much higher light intensity in the zone of concentration.

Figure 5:
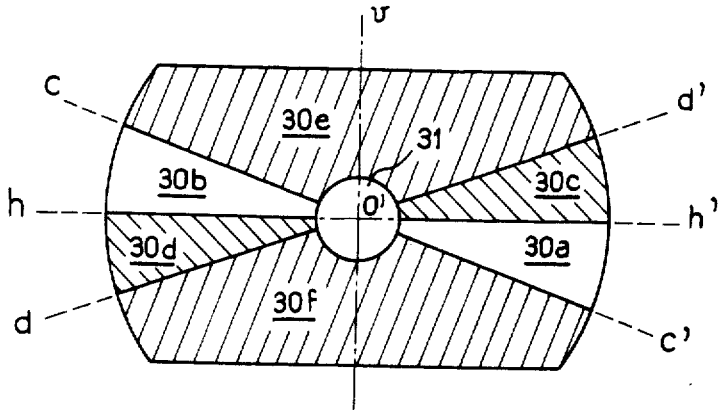
FIG. 5 is a front view of the light-distributing glass of the headlamp in the direction V—V of FIG. 2.

The corresponding zones 30*a* and 30*b* (FIG. 5) of the light-distributing glass are smooth or slightly deviatory. The images coming from the zones 10*a* and 10*b* of the reflector are conveniently positioned with reference to the desired beam and therefore it is not necessary to use the glass to deflect the light rays. However, it is possible to provide circular or inclined prisms which make it possible to deflect the images slightly towards the right in the conventional manner.

Starting from this basic configuration it is possible to intensify the dipped beam still more by using the light rays coming from the zones situated beyond the axial planes hh' and cc' mentioned above, namely the zones 10*c*, 10*d*, 10*e* and 10*f* in FIG. 3.

In a first embodiment these zones are formed by deflecting surfaces which extend the sectors 10*a*, 10*b* in the form of paraboloids without discontinuity to either side of the axial planes, the shape of these surfaces being such that they form images of the filament which are situated below the beam cut-off on the standard screen.

"Absence of discontinuity" should be understood to mean a continuity ensured to the second order between the deflecting surfaces and the sectors in paraboloid form, that is to say that the radii of curvature and the centres of curvature of the surfaces are the same on either side of the connecting line. In practice this arrangement makes it possible to produce actual surfaces having a very good conformity with the theoretical surfaces, thus avoiding the faults which were inherent in the system with "offset paraboloids" described above (in which, furthermore, the surfaces were not connected to each other).

The deflecting surfaces will advantageously be chosen in such a way as to form images of the filament having all their highest points aligned on the beam cut-off. The theoretical calculation shows that the surfaces defined by the following equations have these properties (it will be assumed that the actual surfaces preferably do not diverge from the theoretical surfaces in the radial direction by more than 0.15 mm): for the zones 10*c* and 10*d* (left-hand part of the beam): (equation 1)

$$x = \frac{y^2}{4 f_o} + \frac{z^2}{4\left[f_o - \frac{z}{|z|} \cdot \frac{l}{\left(1 + \frac{y^2}{4 f_o^2}\right)}\right]}$$

for the zones 10*e* and 10*f* (right-hand part of the beam): (equation 3)

$$x = \frac{(y \cos\alpha + z \sin\alpha)^2}{4 f_o} + \frac{(z \cos\alpha - y \sin\alpha)^2}{4\left\{f_o - \frac{z}{|z|} \cdot \frac{l}{1 + \frac{(y \cos\alpha + z \sin\alpha)^2}{4 f_o^2}}\right\}}$$

in which l = half-length of the filament, $f_o$ = focal length of the paraboloid, $\alpha$ = angle of upward inclination of the beam cut-off (15° in general), Ox being the axis of the paraboloid and the plane xOy being a horizontal plane, as shown in FIGS. 2 to 3.

It will be noted that equation 2 is simply deduced from equation 1 by rotation by an angle $\alpha$ about the axis Ox. This rotation makes it possible to transform the horizontal cut-off into a cut-off inclined by the angle of upward inclination. These two surfaces are connected along a line corresponding to their intersection by an axial plane r'r inclined by an angle $\alpha/2$ with respect to the vertical.

A reflector produced in accordance with this teaching has a continuity of the second order on all its surfaces—which notably renders it perfectly capable of being pressed in theory—with the exception of the connecting line r'r where the continuity is only ensured to the first order.

Figure 4B:
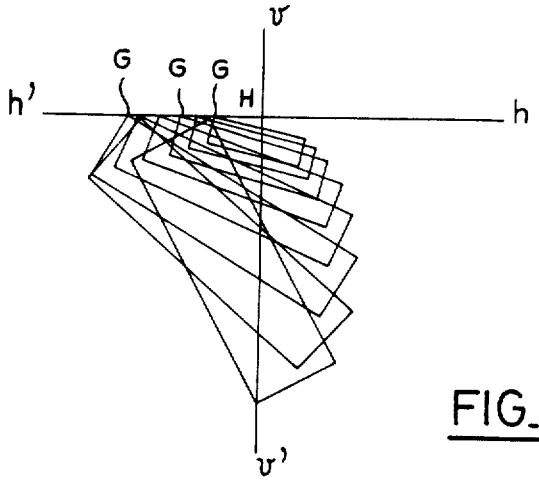

FIG. 4*b* shows the images of the filament obtained on the standard screen following reflection on the surfaces 10*c* and 10*d*. These images principally ensure the left-hand part of the beam, the part which must have a horizontal cut-off. The chosen deflecting surface permits all the images of the filament to have their highest point G aligned on the horizontal h'H, as can be seen in FIG. 4*b*.

Figure 4C:
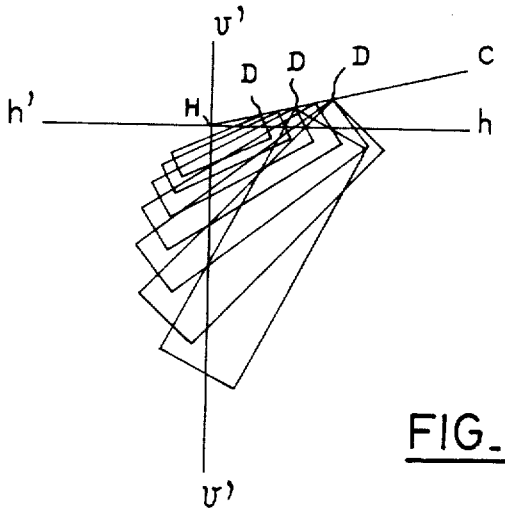

In the same way (FIG. 4*c*) the surfaces 10*e* and 10*f* give images which principally ensure the right-hand part of the beam, the part which must have a raised cut-off Hc, which is obtained by the rotation mentioned above making it possible to pass from equation 1 to equation 2. The highest point D of each image is situated on the raised part Hc of the cut-off. The resulting beam, which is the superimposition of the images of FIGS. 4*a*, 4*b*, and 4*c*, thus not only has an increased overall luminous flux but also a greater intensity in the zones where this is desired (standard points 75R, 50V, 50R and zone IV).

Such a reflector can be used with a glass which improves the distribution of the light beam in a conventional manner, notably by horizontal spreading.

Figure 8:
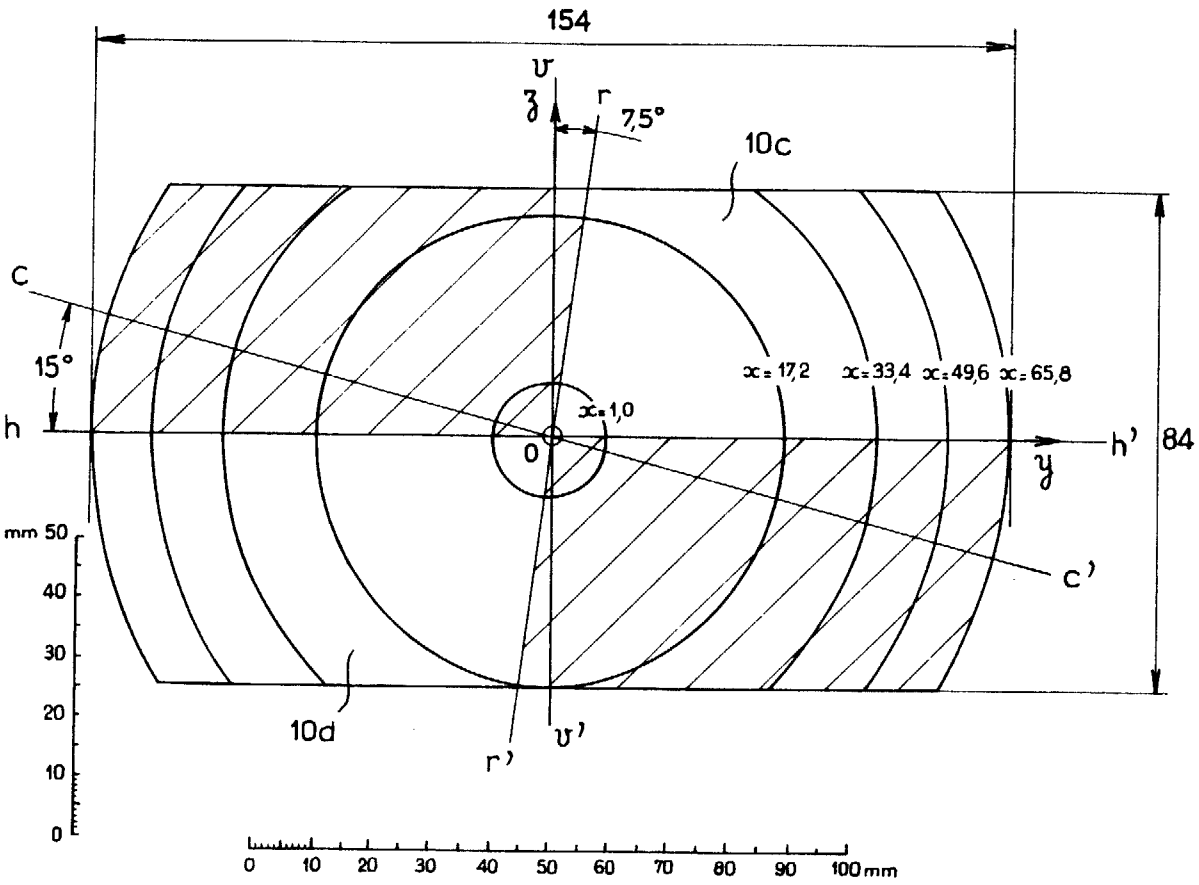
FIG. 8 shows, in front view and in contours, a practical example of a surface produced in accordance with the teaching of the invention.

FIG. 8 shows a practical example of a surface produced in accordance with equation 1 and represented in contour lines, viewed from the front. (Naturally, only the unhatched parts 10*c* and 10*d* will be effectively utilised in the reflector according to FIG. 3). This surface corresponds to a rectangular headlamp with a height of 84 mm and maximum aperture of 154 mm for a focal distance $f_o$ = 22.5 mm and a filament with a length 2l = 5.5 mm and a diameter $2\delta$ = 1.2 mm.

Figure 9:
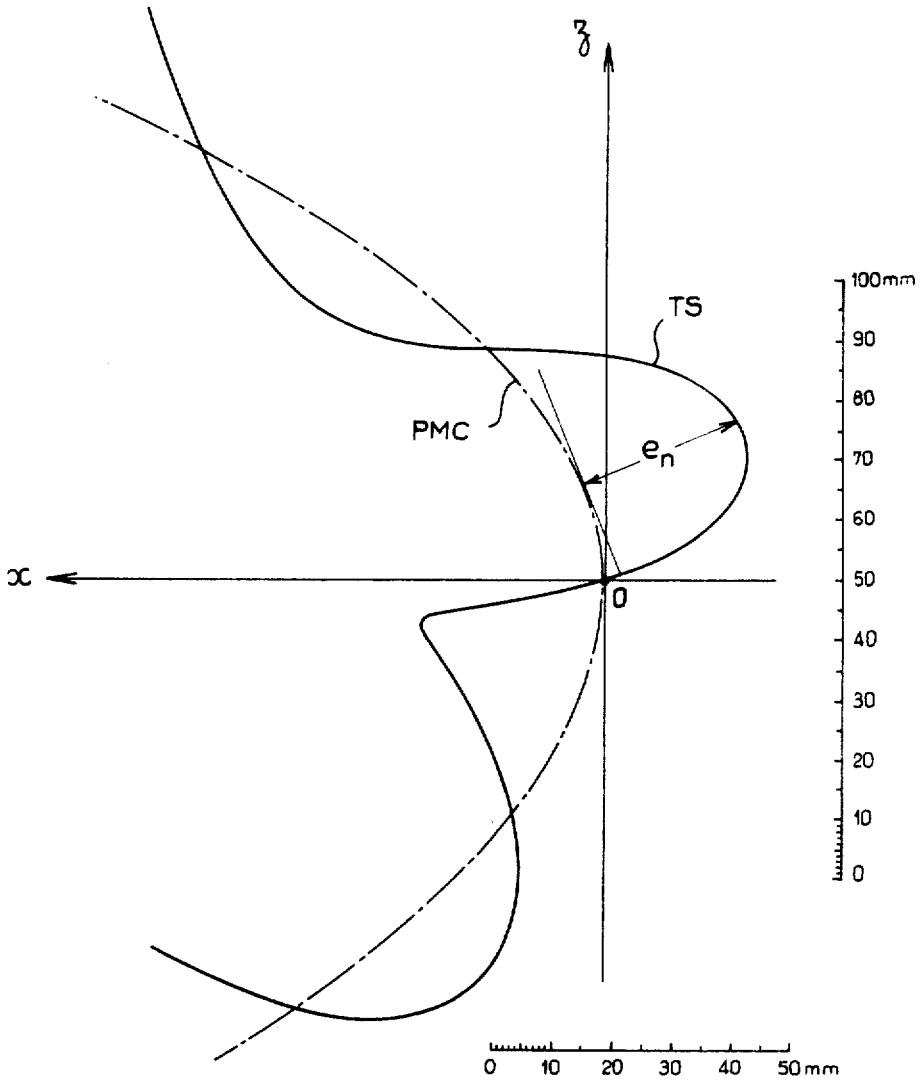
FIG. 9 shows in the vertical plane xOz the divergence of the surface according to FIG. 8 with reference to a parabola of least squares.

FIG. 9 shows in the vertical axial plane xOz the trace TS of the surface according to FIG. 8, compared with its parabola of least squares PCM. The normal distance $e_n$ separating the two curves has been amplified by 100 for reasons of clarity.

"Parabola of least squares" should be understood to mean the parabola such that the mean quadratic distance separating this parabola from the surface in question in the normal direction is the smallest possible. Thus it is a matter of the "best parabola", that which comes closest to the trace TS.

The parabola PMC thus found and represented in FIG. 9 has a focal distance of 21.84 mm and an apex of co-ordinates x = 0.03 mm and z = 0.66 mm; it is slightly inclined downwards by 5.63%. In these circumstances, and in a manner which is characteristic of the invention, the normal distance $e_n$ always remains below 0.3 mm.

In a second embodiment the light-distributing glass 30, in combination with the deflecting surfaces of the reflector, serves as deflector means to displace below the cut-off the images produced by reflection on all the zones of the reflector situated outside the axial planes hh' and cc'.

In a preferred form the paraboloid of the zones 10*a* and 10*b* is extended beyond the aforesaid axial planes. The different zones 10*a* to 10*f* according to FIG. 3 are then replaced by a single paraboloid having a focus F. Since the zones 10*a* and 10*b* do not produce images situated above the cut-off (FIG. 4*a*), the corresponding zones 30*a* and 30*b* of the glass (FIG. 5) will, as previously, be smooth or slightly deviatory.

The zones of the paraboloid which are symmetrical with the zones 10*a* and 10*b* with reference to the vertical plane v'v produce images which are symmetrical with those shown in FIG. 4 with respect to the vertical plane v'v, tending to create a cut-off inclined upwards towards the left. As it is necessary in this zone to have a horizontal cut-off, the images obtained are displaced so as to bring them all below the cut-off.

This displacement is obtained by the corresponding zones 30*c* and 30*d* of the light distributing glass situated between the horizontal plane hh' and the axial plane dd' (symmetrical with the plane cc' with respect to the horizontal plane hh').

Figure 6A:
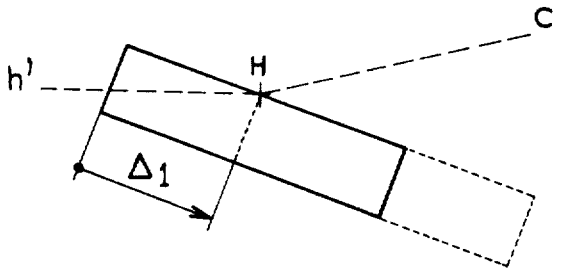
FIGS. 6*a* and 6*b* show two ways of using the glass of FIG. 5 to displace the image of a filament obtained on the standard screen.
Figure 6B:
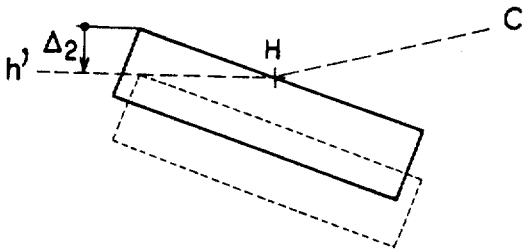

This displacement can be achieved in different ways. Firstly, it may be achieved by a deflection $\Delta_1$ of the images in the direction of their length (FIG. 6*a*), that is to say downwards and towards the right, using either cirular prisms or prisms of mean inclination. Alternatively, the images can be displaced vertically (FIG. 6*b*), which necessitates lesser deflections $\Delta_2$ than in the previous way and thus only slight extra thicknesses on the light-distributing glass. This deflection can be optionally combined with horizontal spreading of the images.

Figure 7:
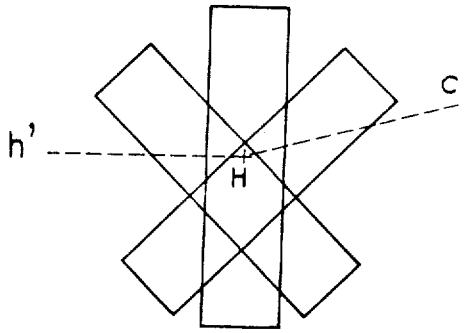
FIG. 7 shows the images of the filament, also on the standard screen, corresponding to the upper zones of the reflector in the second embodiment before deflection by the light-distributing glass.

The zones of the paraboloid situated outside the axial planes cc' and dd' defining the sectors previously studied give images such as those shown in FIG. 7. Almost half the length of the images is situated above the cut-off line h'Hc. It will therefore be necessary to lower these images either vertically or obliquely and to spread them at the same time. In all cases this involves significant extra thicknesses of the glass.

In the event that the light distributor is made from plastics material it is possible to tolerate significant extra thicknesses since the moulding is done accurately and without clearances. In the case of light distributor made from glass it is difficult to obtain significant extra thicknesses by moulding.

One or more prismatic elements which are made from plastics material and can be easily moulded can then be provided between the glass light distributor and the reflector. These elements can be crimped or adhered on the glass or fixed on the reflector, or they can cover the entire reflector itself if they only produce an effective deflection on a part thereof.

Naturally, any intermediate solution between the two examples described above can be envisaged, the deflector effect being partially obtained by the deflecting surfaces extending the paraboloid (sectors 10c to 10f) and partially by the light-distributing glass which co-operates with the deflecting surfaces in such a way that the optical assembly of reflector and glass forms images of the filament in which all the points are situated below the beam cut-off.

In addition, when the reflector is truncated by two plane sides 12, 13 (FIG. 2), it can be advantageous to provide that these sides are not relfecting so as to avoid any great diffusion of light above the cut-off.

Furthermore, practical tests have shown that the lower part of the reflector (situated below the plane hh') gives better results than the upper part from the point of view of the sharpness of the cut-off.

An asymmetric reflector can be provided in which the total height $z_1$ below the axis Ox is greater than the total height $z_2$ above the said axis.

For example, for a focal length $f_o$ of 22.5 mm one could choose $z_1 = 50$ mm and $z_2 = 30$ mm.

Obviously, numerous modifications and variations of the present invention are possible in the light of the above teachings. It is therefore to be understood that within the scope of the appended claims, the invention may be practiced otherwise than as specifically described herein.

What is claimed as new and desired to be secured by Letters Patent of the United States is:

1. A headlamp for forming a dipped beam having a cut-off with a portion horizontal and a portion at an upward angle of inclination when projected onto a vertical screen at 25 meters, said headlamp comprising: a reflector comprising at least one paraboloidal sector having a focus and a longitudinal axis of revolution, and extending symmetrically on either side of the paraboloidal axis between two axial planes, one of said planes being horizontal and the other of said planes forming with said first plane an angle equal to said angle of upward inclination of said cut-off of said dipped beam; a bulb having an axial filament and adapted to emit light rays throughout 360, said filament being on the one hand offset upwardly in the radial direction with respect to said paraboloidal axis and on the other hand centered in the axial direction on said focus of said paraboloid; a light-distributing glass placed in front of said reflector having zones which are homologous to said paraboloidal sector and which do not substantially deviate said light, and deflector means to displace below said beam cut-off all images of said filament coming from the zone of the reflector extending beyond said two axial planes, said deflector means comprising deflecting surfaces which extend said paraboloidal sector on either side of said axial planes with continuity.

2. A headlamp according to claim 1, wherein said filament is offset by a distance whereby its emitting surface is substantially tangential to said axis.

3. A headlamp according to claim 1, wherein that the distance from the emitting surface of said filament to said axis does not exceed 25% of the diameter of said filament in one direction or the other.

4. A headlamp according to claim 1, wherein the distance separating the centre of said filament from said focus of said paraboloid does not exceed 10% of the length of said filament in one direction or the other.

5. A headlamp according to claim 1 wherein said light-distributing glass is arranged to spread the beam horizontally.

6. A headlamp according to claim 1, wherein said reflector is truncated by two plane sides each having a non-reflecting surface.

7. A headlamp according to claim 1, wherein the total height of said reflector below said axis is greater than its total height above said axis.

8. A headlamp according to claim 1, wherein said deflecting surfaces co-operate with homologous deflecting zones in said light-distributing glass in such a way as to form images of the filament in which all the points are situated below said beam cut-off.

9. A headlamp according to claim 8, wherein said deflecting surfaces are formed by said paraboloid extended beyond said axial planes.

10. A headlamp according to claim 9, wherein said deflecting zones of said light-distributing glass are provided with prisms arranged to displace in the direction of their greatest dimension the images of said filament coming from said zone of said paraboloid extending beyond said radial planes, this displacement being of such an amplitude that all the points of said images of said filament are situated below said beam cut-off.

11. A headlamp according to claim 9, wherein said deflecting zones of said light-distributing glass are provided with prisms arranged to displace vertically downwards said images of said filament coming from said zone of said paraboloid extending beyond said radial planes, this displacement being of such an amplitude that all the points of said images of said filament are situated below said beam cut-off.

12. A headlamp according to claim 1, wherein said deflecting surfaces form images of said filament in which all points are situated below said beam cut-off, and wherein said light-distributing glass has zones which are homologous to said zones of said reflector extending beyond said two axial planes and which are smooth or slightly deviatory in the vertical direction.

13. A headlamp according to claim 12 wherein said deflecting surfaces form images of said filament whose highest points are aligned on said beam cut-off.

14. A headlamp according to claim 13, wherein said deflecting surfaces are defined by the following equations:

$$x = \frac{y^2}{4 f_o} + \frac{z^2}{4\left[f_o - \frac{z}{|z|} \cdot \frac{l}{\left(1 + \frac{y^2}{4 f_o^2}\right)}\right]}$$

$$x = \frac{(y \cos\alpha + z \sin\alpha)^2}{4 f_o} +$$

-continued $$\frac{(z \cos\alpha - y \sin\alpha)^2}{4\left\{f_o - \frac{z}{|z|} \cdot \frac{l}{1 + \frac{(y \cos\alpha + z \sin\alpha)^2}{4 f_o^2}}\right\}}$$

in which l = half-length of said filament, $f_o$ = focal length of said paraboloid, $\alpha$ = angle of upward inclination of said beam cut-off, Ox is said paraboloidal axis and xOy is a horizontal plane.

15. A headlamp according to claim 14, wherein the distance in the radial direction separating said deflecting surfaces from said surfaces defined by the said equations does not exceed 0.15 mm.

16. A headlamp according to claim 14, wherein, in the vertical plane passing the origin of the co-ordinates of the equations, the normal distance separating the trace of each of said deflecting surfaces from the corresponding parabola of least squares does not exceed 0.3 mm.

* * * * *